US009492865B2

(12) United States Patent
Xue et al.

(10) Patent No.: US 9,492,865 B2
(45) Date of Patent: Nov. 15, 2016

(54) TAKE OUT DEVICE OF WHEEL DIE CASTING MACHINE

(71) Applicant: CITIC Dicastal CO., LTD, Qinhuangdao (CN)

(72) Inventors: Bowen Xue, Qinhuangdao (CN); Yacong Zhang, Qinhuangdao (CN); Jiandong Guo, Qinhuangdao (CN); Yongning Wang, Qinhuangdao (CN); Zhihua Zhu, Qinhuangdao (CN); Changhai Li, Qinhuangdao (CN); Binyu Xiong, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 0 days.

(21) Appl. No.: 14/982,688

(22) Filed: Dec. 29, 2015

(65) Prior Publication Data

US 2016/0184889 A1 Jun. 30, 2016

(30) Foreign Application Priority Data

Dec. 29, 2014 (CN) ..... 2014 1 0833349

(51) Int. Cl.

| | |
|---|---|
| ***B22D 29/08*** | (2006.01) |
| ***B22D 31/00*** | (2006.01) |
| ***B22D 17/22*** | (2006.01) |

(52) U.S. Cl.

CPC ..... *B22D 29/08* (2013.01); *B22D 17/2236* (2013.01); *B22D 31/00* (2013.01)

(58) Field of Classification Search

CPC .. B22D 17/2236; B22D 29/04; B22D 29/08; B22D 31/00

USPC ..... 164/69.1, 113, 131, 270.1, 312, 344, 164/404

See application file for complete search history.

(56) References Cited

U.S. PATENT DOCUMENTS

| | | | | |
|---|---|---|---|---|
| 4,840,557 A * | 6/1989 | Ishimoto | ..... | B22D 17/12 164/312 |
| 5,143,141 A * | 9/1992 | Frulla | ..... | B22D 18/02 164/120 |
| 5,433,263 A * | 7/1995 | Ohnishi | ..... | B22D 17/2236 164/347 |

FOREIGN PATENT DOCUMENTS

CN 203304537 U * 11/2013

* cited by examiner

*Primary Examiner* — Kevin E Yoon

(74) *Attorney, Agent, or Firm* — Maier & Maier, PLLC

(57) ABSTRACT

The present invention provides a take out device of the wheel die casting machine, consisting of a guide sleeve, a guide post, a cylinder, a motor, a fixture and a bearing seat, etc. When in use, the take out device provided by the present invention can stably receive the wheels produced by die-casting and then remove the four joint flashes, so that the problems that the wheel directly drops onto a tray to cause knock damage on the facade and the flashes become hard and are difficult to be removed after the wheel is cooled by dipping in water are solved, and meanwhile, the take out device has the advantages of simple structure, low manufacturing cost and safe and stable performance.

1 Claim, 2 Drawing Sheets

TAKE OUT DEVICE OF WHEEL DIE CASTING MACHINE

TECHNICAL FIELD

The present invention relates to the field of wheel casting, and particularly to a take out device of the wheel die casting machine.

BACKGROUND ART

In a low pressure casting production process of aluminum alloy wheels, the temperature of just demolded wheel is very high, and the overall hardness of the wheel is lower. The traditional material receiving method is that a tray rotates to the lower side of the wheel, a mandril pushes out the wheel from an upper mold, and then the facade of the wheel drops onto the tray, and in this manner, it is easy to generate knock damages on the facade of the wheel to increase the rejection rate.

In addition, the traditional manner for removing joint flashes is to remove the joint flashes after cooling the wheel by dipping in water. After being cooled, the flashes have high hardness, and thus being unlikely to be removed.

Therefore, a take out device of the wheel die casting machine is urgently needed to overcome the various aforementioned problems.

SUMMARY OF THE INVENTION

The purpose of the present invention is to provide a take out device, which can automatically and stably receive a just demolded wheel and fulfill a flash removal function.

To fulfill the aforementioned purpose, the technical solution of the present invention is as follows: a take out device of the wheel die casting machine is composed of a guide post, a lower guide sleeve, a fixing plate, a lifting cylinder, a lifting plate, an upper guide sleeve, a spring, an upper plate, a bearing seat, a corner cylinder, a fixture, a rotating platform, a rotating shaft, a turning tool, a tool apron, a guide rail, a feed cylinder, a supporting seat, a motor, a rotating arm and a rotating bearing seat, wherein the lower end of the fixing plate fixed with four lower guide sleeves and two lifting cylinders is connected with the rotating arm; output rods of the lifting cylinders are hinged with the lifting plate fixed with four upper guide sleeves; four guide posts and the motor are fixed below the upper plate, and the bearing seat is fixed at the upper end of the upper plate; the springs are sleeved on the guide posts and are fixed between the lifting plate and the upper plate; the four guide posts are respectively matched with the four upper guide sleeves and the four lower guide sleeves; the rotating platform installed with three corner cylinders and the fixture at the upper side is connected with the upper side of the rotating shaft fixed in the bearing seat; the output end of the motor is connected with the lower end of the rotating shaft; the tool apron is connected with the upper end of the supporting seat via the guide rail; the turning tool is installed in the tool apron; the feed cylinder is fixed on the side face of the supporting seat, and the output rod of the feed cylinder is connected with the tool apron; and the bearing seat is fixed at the tail end of the rotating arm and is connected to a certain position of the wheel die casting machine.

One aspect of the present invention provides a take out device of the wheel die casting machine, consisting of a guide post (1), a lower guide sleeve (2), a fixing plate (3), a lifting cylinder (4), a lifting plate (5), an upper guide sleeve (6), a spring (7), an upper plate (8), a bearing seat (9), a corner cylinder (10), a fixture (11), a rotating platform (12), a rotating shaft (13), a turning tool (14), a tool apron (15), a guide rail (16), a feed cylinder (17), a supporting seat (18), a motor (19), a rotating arm (20) and a rotating bearing seat (21), characterized in that the lower end of the fixing plate (3) fixed with four lower guide sleeves (2) and two lifting cylinders (4) is connected with the rotating arm (20); output rods of the lifting cylinders (4) are hinged with the lifting plate (5) fixed with four upper guide sleeves (6); four guide posts (1) and the motor (19) are fixed below the upper plate (8), and the bearing seat (9) is fixed at the upper end of the upper plate; the springs (7) are sleeved on the guide posts (1) and are fixed between the lifting plate (5) and the upper plate (8); the four guide posts (1) are respectively matched with the four upper guide sleeves (6) and the four lower guide sleeves (2); the rotating platform (12) installed with three groups of corner cylinders (10) and the fixture (11) at the upper side is connected with the upper side of the rotating shaft (13) fixed in the bearing seat (9); the output end of the motor (19) is connected with the lower end of the rotating shaft (13); the tool apron (15) is connected with the upper end of the supporting seat (18) via the guide rail (16); the turning tool (14) is installed in the tool apron (15); the feed cylinder (17) is fixed on the side face of the supporting seat (18), and the output rod of the feed cylinder is connected with the tool apron (15); and the bearing seat (21) is fixed at the tail end of the rotating arm (20) and is connected with the wheel die casting machine.

In actual use, when a wheel is about to demold, the lifting cylinders lift the upper plate, the motor, the fixture and the rotating platform and the like by the lifting plate and four springs, after the wheel touches the fixture, the springs are slightly compressed, at this time, the three corner cylinders clamp the wheel, and a mandril pushes out the wheel from an upper mold; after the lifting cylinders lower the wheel to a certain position by the guide posts and the springs, the entire device is rotated out from the die casting machine by the rotating arm and the rotating bearing seat; and after staying for half a minute, the feed cylinder drives the turning tool to touch an outer rim of the wheel by the guide rail, the motor drives the wheel to rotate, and at this time, four joint flashes produced after die-casting can be removed.

When in use, the take out device provided by the present invention can stably receive the die cast wheel and then remove the four joint flashes, so that the problems that the wheel directly drops onto a tray to cause knock damage on the facade and the flashes become hard and are difficult to be removed after the wheel is cooled by dipping in water are solved, and meanwhile, the take out device has the advantages of simple structure, low manufacturing cost and safe and stable performance. The device provided by the present invention has a simple structure, and the manufacturing cost is very low.

BRIEF DESCRIPTION OF THE DRAWINGS

Embodiments of the present invention will be described below in detail in combination with the accompanying drawings, wherein.

Figure 1:
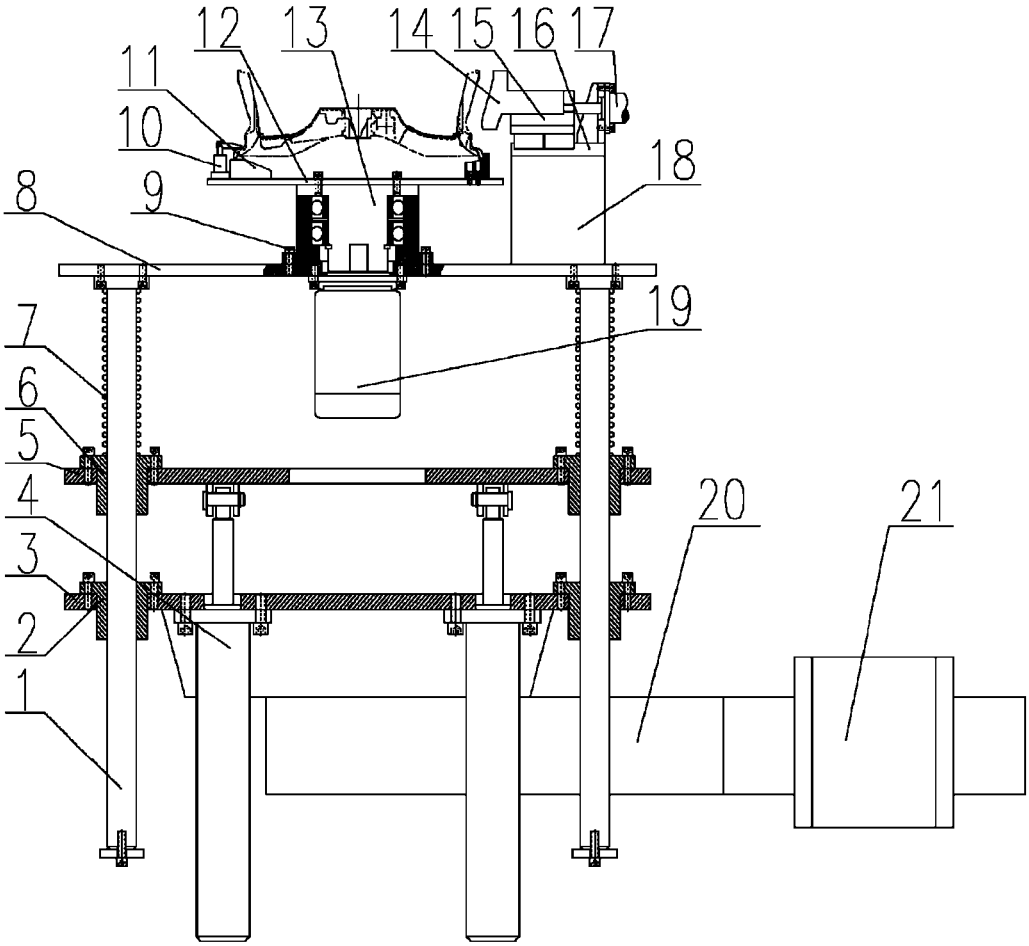
FIG. 1 is a front view of a take out device of the wheel die casting machine of the present invention.
Figure 2:
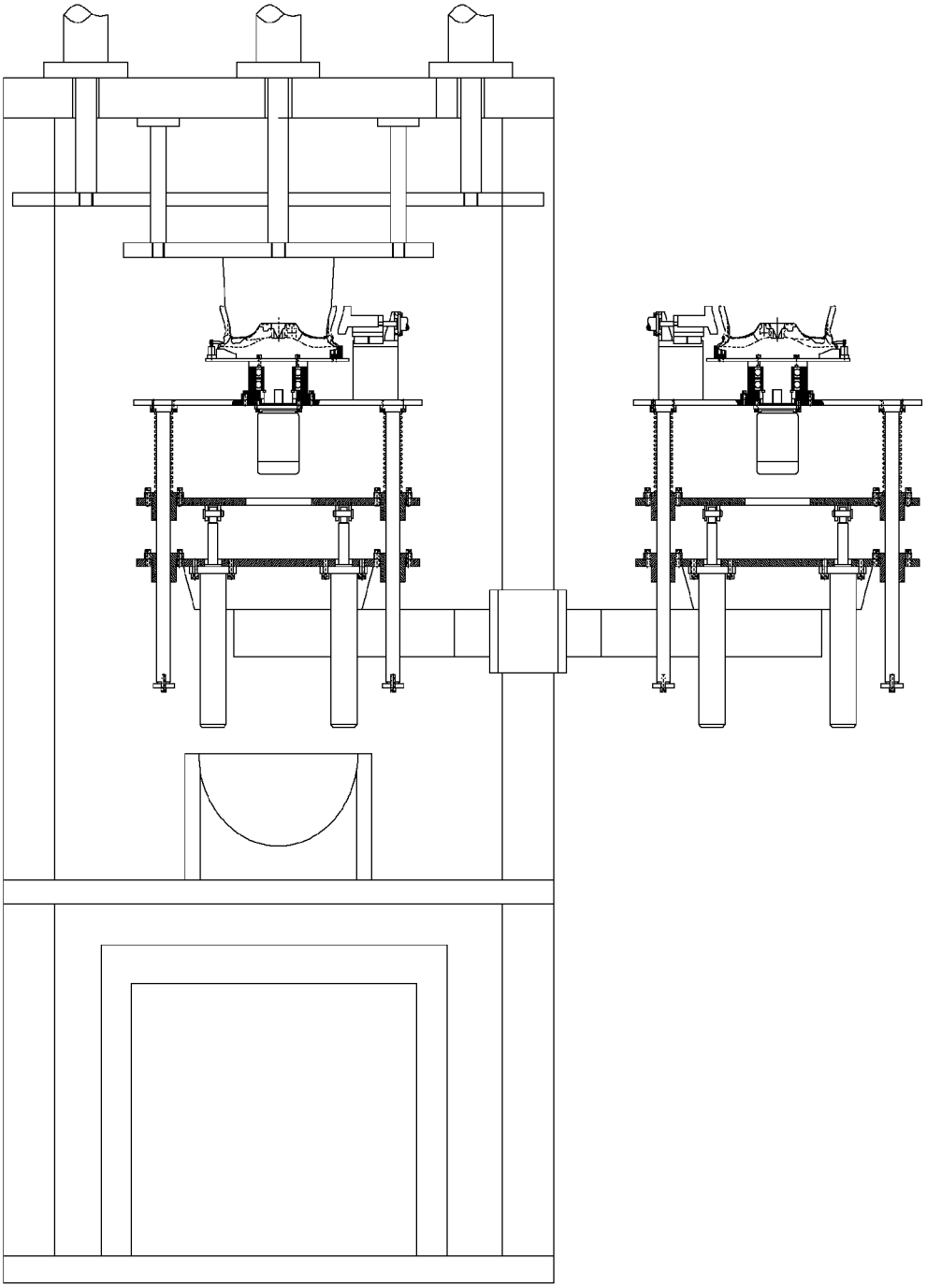
FIG. 2 is a working view of a take out device of the wheel die casting machine of the present invention.

In the figures, 1—guide post, 2—lower guide sleeve, 3—fixing plate, 4—lifting cylinder, 5—lifting plate, 6—upper guide sleeve, 7—spring, 8—upper plate, 9—bearing seat, 10—corner cylinder, 11—fixture, 12—rotating platform, 13—rotating shaft, 14—turning tool, 15—tool apron, 16—guide rail, 17—feed cylinder, 18—supporting seat, 19—motor, 20—rotating arm, and 21—rotating bearing seat.

DETAILED DESCRIPTION OF THE EMBODIMENTS

Details and working conditions of a specific device proposed by the present invention will be illustrated below in combination with the accompanying drawings.

The device is composed of a guide post 1, a lower guide sleeve 2, a fixing plate 3, a lifting cylinder 4, a lifting plate 5, an upper guide sleeve 6, a spring 7, an upper plate 8, a bearing seat 9, a corner cylinder 10, a fixture 11, a rotating platform 12, a rotating shaft 13, a turning tool 14, a tool apron 15, a guide rail 16, a feed cylinder 17, a supporting seat 18, a motor 19, a rotating arm 20 and a rotating bearing seat 21, wherein the lower end of the fixing plate 3 axed with four lower guide sleeves 2 and two lifting cylinders 4 is connected with the rotating arm 20; output rods of the lifting cylinders 4 are hinged with the lifting plate 5 fixed with four upper guide sleeves 6; four guide posts 1 and the motor 9 are fixed below the upper plate 8, and the bearing seat 9 is fixed at the upper end of the upper plate; the springs 7 are sleeved on the guide posts 1 and are fixed between the lifting plate 5 and the upper plate 8; the four guide posts 1 are respectively matched with the four upper guide sleeves 6 and the four lower guide sleeves 2; the rotating platform 12 installed with three groups of corner cylinders 10 and the fixture 11 at the upper side is connected with the upper side of the rotating shaft 13 fixed in the bearing seat 9; the output end of the motor 19 is connected with the lower end of the rotating shaft 13; the tool apron 15 is connected with the upper end of the supporting seat 18 via the guide rail 16; the turning tool 14 is installed in the tool apron 15; the feed cylinder 17 is fixed on the side face of the supporting seat 18, and the output rod of the feed cylinder is connected with the tool apron 15; and the bearing seat 21 is fixed at the tail end of the rotating arm 20 and is connected with a body portion of the wheel die casting machine.

In a working process, when a wheel is about to demold, the lifting cylinders 4 lift the upper plate 8, the motor 19, the fixture 11 and the rotating platform 12 and the like by the lifting plate 5 and four springs 7, after the wheel touches the fixture 11, the springs 7 are slightly compressed, at this time, the three corner cylinders 10 clamp the wheel, and a mandril pushes out the wheel from an upper mold; after the lifting cylinders 4 lower the wheel to a certain position by the guide posts 1 and the springs 7, the entire device is rotated out from the die casting machine by the rotating arm 20 and the rotating bearing seat 21; and after staying for half a minute, the feed cylinder 17 drives the turning tool 14 to touch an outer rim of the wheel by the guide rail 16, the motor 19 drives the wheel to rotate, and at this time, four joint flashes produced after die-casting can be removed.

The invention claimed is:

1. A take out device of the wheel die casting machine, comprising:

four guide posts, a lower guide sleeve, a fixing plate, a lifting plate, four upper guide sleeves, springs, an upper plate, a bearing seat, a corner cylinder, a fixture, a rotating platform, a rotating shaft, a turning tool, a tool apron, a guide rail, a feed cylinder, a supporting seat, a motor, a rotating arm and a rotating bearing seat, wherein the lower end of the fixing plate fixed with four lower guide sleeves and two lifting cylinders is connected with the rotating arm; output rods of the lifting cylinders are hinged with the lifting plate fixed with the four upper guide sleeves; the four guide posts and the motor are fixed below the upper plate, and the bearing seat is fixed at the upper end of the upper plate; the springs are sleeved on the guide posts and are fixed between the lifting plate and the upper plate; the four guide posts are respectively matched with the four upper guide sleeves and the four lower guide sleeves; the rotating platform installed with three groups of corner cylinders and the fixture at the upper side is connected with the upper side of the rotating shaft fixed in the bearing seat; the output end of the motor is connected with the lower end of the rotating shaft; the tool apron is connected with the upper end of the supporting seat via the guide rail; the turning tool is installed in the tool apron; the feed cylinder is fixed on the side face of the supporting seat, and the output rod of the feed cylinder is connected with the tool apron; and the bearing seat is fixed at the tail end of the rotating arm and is connected with the wheel die casting machine.

* * * * *